United States Patent [19]

Brewer et al.

[11] 4,287,619

[45] Sep. 8, 1981

[54] MULTI-PURPOSE CHAIR FOR THE PARTIALLY DISABLED

[76] Inventors: William R. Brewer, 9100 Bartee Ave., Arleta, Calif. 91331; Hamilton C. de Jong, 254 S. Berkeley Ave., Pasadena, Calif. 91107

[21] Appl. No.: 21,919

[22] Filed: Mar. 19, 1979

[51] Int. Cl.[3] ..... A47K 11/04; A47C 7/42; A47C 7/62

[52] U.S. Cl. ..... 4/483; 5/81 R; 5/90; 297/417; 297/440; 297/DIG. 4

[58] Field of Search ..... 4/134, 185 S, 185 R, 4/185 B, 185 AB, 254, 483, 531, 532, 571, 572, 578, 579, 589, 590, 654, 659, 234, 237; 297/411, 416, 417, 440, 444, 445, DIG. 4; 5/81 R, 90, 86; D6/9, 38; D23/48, 71

[56] References Cited

U.S. PATENT DOCUMENTS

| | | | |
|---|---|---|---|
| 1,188,550 | 6/1916 | Meyer | 4/134 |
| 1,325,423 | 12/1919 | Stuart | 4/185.5 |
| 1,409,816 | 3/1922 | Bell | 297/444 X |
| 1,428,627 | 9/1922 | Grabfelder | 4/134 X |
| 2,670,029 | 2/1954 | Rossi | 4/185.5 |
| 2,683,483 | 7/1954 | Shepherdson | 297/416 X |
| 3,266,843 | 8/1966 | Feder | 297/440 |
| 3,341,864 | 9/1967 | Wichmann | 297/416 |
| 3,484,877 | 12/1969 | Peterson | 297/416 X |
| 3,632,150 | 1/1972 | Milakovich | 297/440 X |
| 4,155,588 | 5/1979 | Danziger et al. | 297/417 X |

*Primary Examiner*—Stuart S. Levy
*Attorney, Agent, or Firm*—Charlton M. Lewis

[57] ABSTRACT

The chair of the invention comprises a chair frame and accessories which can be assembled in various combinations and can be operated in various modes to perform a plurality of functions by which persons with physical limitations can become more independent while bathing or toileting. The chair legs can fit inside of a bathtub or shower allowing the chair to become a bath aid, yet, the chair legs are sufficiently wide to allow the chair with a toilet seat to straddle a conventional toilet as a toilet seat riser. The removable back allows the chair to be positioned properly over the toilet bowl, and the structure allows lateral access for perineal therapy. A commode pan is insertable below the seat to convert the chair into a commode. For those uses the chair further provides side handholds or raised armrests as desired. An armrest from either side converts to a bridgeboard which extends laterally, allowing the person to transfer in a sitting position to and from a wheelchair, for example. The structure allows the chair to be coated to prevent corrosion and to allow cleaning. Structural features are described which aid operation and reduce cost.

13 Claims, 6 Drawing Figures

MULTI-PURPOSE CHAIR FOR THE PARTIALLY DISABLED

BACKGROUND OF THE INVENTION

This invention is concerned generally with providing furniture and related apparatus for facilitating self-care activities of partially disabled persons, such as chronic invalids and medical patients during rehabilitation.

In the early stages of rehabilitation a trip to the bathroom is often out of the question and a patient with mobility limitations requires a bedside commode for toileting. Whereas conventional commodes are well known, they are commonly bulky and relatively expensive.

Later, as the mobility of the patient improves, toileting can be resumed in the bathroom provided that the low height of the toilet does not present difficulties for the patient when getting down or up. That problem is sometimes met by providing a special device which fits over a toilet bowl and serves as a toilet riser. Again, such a device is normally quite expensive, partly due to the difficulty in properly and safely fitting the wide variety of sizes and shapes of conventional toilet bowls.

Some patients when bathing do not have the strength to get up from the bottom of the tub, and therefore must shower. However, standing in the shower is not always feasible and may involve appreciable risk and inconvenience, especially when washing the lower limbs. Many devices are known for aiding an invalid in the bathtub, but these tend to be either relatively expensive or not entirely safe.

Moreover, it is difficult for an invalid who cannot stand to transfer safely between a wheelchair, for example, and a conventional bathing device, a toilet, or even a bed or conventional chair. Previously available apparatus for aiding transfers of that type tend to be awkward in use and to provide limited stability.

A further source of difficulty in providing selfcare apparatus is the small space that is normally available for manipulating and for storing such apparatus, especially in the typical bathroom. That condition places a high premium on the development of compact units that are capable of serving many different functions.

SUMMARY OF THE INVENTION

The present invention contributes in an effective and economical manner to the solution of all those difficulties. It provides a compact and convenient multipurpose chair assembly which can function as a bedside commode during early stages of rehabilitation when a trip to the bathroom is not feasible; as a toilet riser for solving the problems many patients experience due to the relatively low height of conventional toilets when bathroom toileting is resumed; and as a safety chair in the shower or bathtub for permitting patients with limited strength to achieve relative independence and privacy while bathing. The chair structure also includes bridgeboard means for making a sliding transfer in a sitting position between the chair itself and another support such as a bed, the seat of a wheelchair or other chair, or the like.

Moreover, when a bridgeboard is not in use for such purpose it can be individually stowed, typically by the invalid without assistance, at the side of the chair, where it performs the additional function of supplying a secure armrest. That capability provides the important specific advantage, when using the chair in a shower, that the patient can transfer to the chair, stow the bridgeboard and then fully close the shower door or curtain. Thus, complete privacy is made possible and the common problem of splashing water outside the shower is avoided.

In preferred form of the invention, applicant's multipurpose chair structure further includes integrally formed horizontal bars at the side edges of the seat, which provide firm handholds for assisting some of the described operations.

This application is directed to the novel combination of mechanical structures and operative features by which the present invalid's chair is enabled to perform some or all of the interrelated functions described herein. The presently preferred form of that chair structure, as illustratively described and shown in the present application, further embodies a novel decorative design which is the subject of the copending application for design patent, Ser. No. 21,627, filed Mar. 19, 1979. It will be evident that many modifications can be made in the particulars, and especially in the appearance, of the present illustrative structure without interfering with its effective performance of the intended functions and without departing from the proper scope of the present invention as defined in the appended claims.

BRIEF DESCRIPTION OF THE DRAWING

A full understanding of the present invention and of its further objects and advantages will be had from the following description of a preferred manner of carrying it out. The particulars of that description, and of the accompanying drawings which form a part of it, are intended only as illustration and not as a limitation upon the scope of the invention, which is described in the appended claims.

In the drawings.

DESCRIPTION OF PREFERRED EMBODIMENTS

Figure 1:
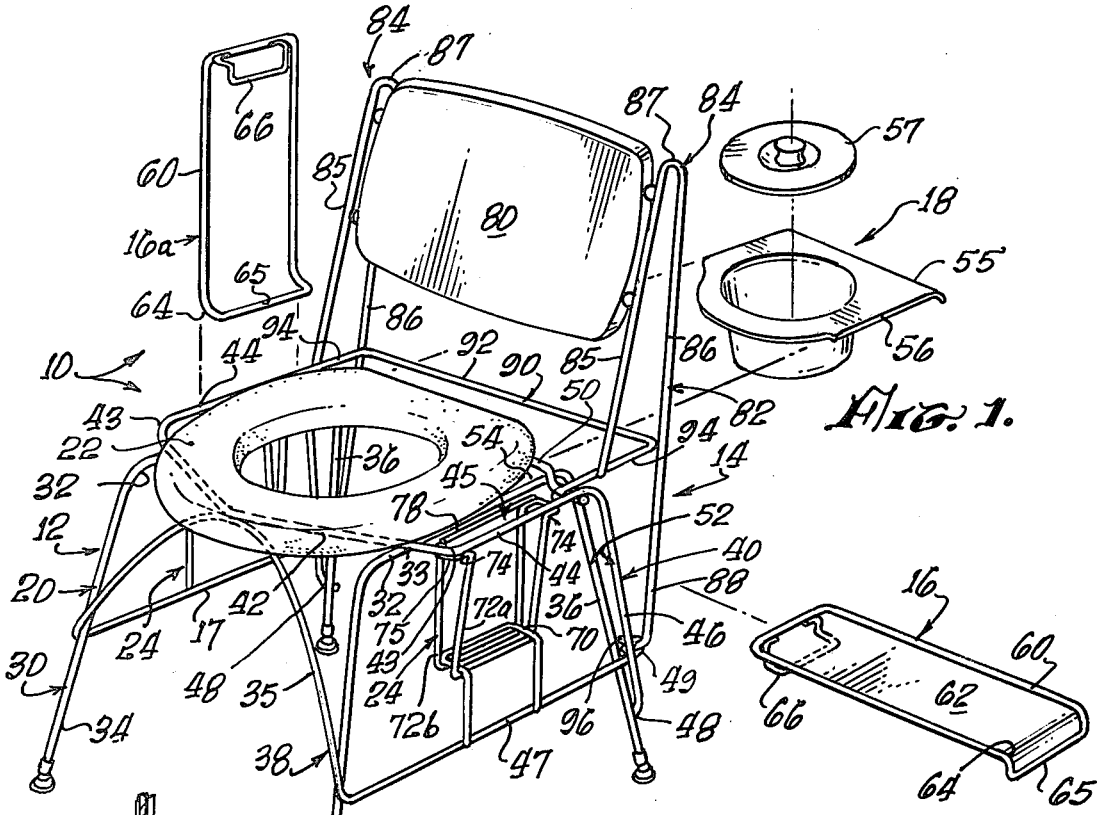
FIG. 1 is a schematic perspective of an illustrative chair assembly in accordance with the invention, showing portions of the assembly in exploded form.

As shown illustratively in the drawings, the chair assembly 10 comprises the chair unit 12, the releasably attachable back unit 14, one or more transfer boards 16 and the commode pan assembly 18 which includes the commode pan 55 and cover 57.

Chair unit 12 typically comprises the main frame 20 with the rigidly supported seat 22. That seat is shown typically as a toilet seat, but for some aspects of the invention a conventional seat of any suitable design may be substituted. Main frame 20 also carries right and left vertical guide structures 24, which are typically welded to the frame and form a permanent unit with it.

Main frame 20 is typically symmetrical with respect to a fore-and-aft vertical central plane 26, and any description of structure on one side of the frame may be assumed, in absence of indication to the contrary, to apply also to the corresponding structure on the other half.

The main frame is formed preferably of four unitary elongated members which are bent to suitable configurations and are rigidly joined, as by welding, to form an effectively integral whole. Those basic members are shown illustratively as solid rods of uniform diameter. However, one or more of them may be tubular, or of channel, angle or like section, and may vary in transverse dimensions, for example to provide strength or stiffness that varies in a desired manner along the length of the member. Such use of only four unitary members has been found to permit especially convenient and economical fabrication of the novel structural and functional features to be described.

Two of those basic frame members are the right and left side members 30, each of which comprises the horizontal side section 32 and the generally vertical front and rear leg sections 34 and 36, respectively. Another basic member is the relatively complex primary member 40, comprising the front horizontal section 42, the two horizontal rail sections 44, and the two generally vertical rear leg sections 46. Finally, the cross member 50 extends laterally at the rear of the chair frame with each end rigidly joined both to side member 30 and to primary member 40.

The two rear leg sections 36 and 46 at each side of the chair are mutually spaced at the seat level by a distance defined by their connections to cross member 50. Those leg sections preferably converge downward at a small acute angle and are finally welded together at 48 near the foot of the leg, forming an inherently sturdy triangular structure 52. Those triangular structures on both sides of the chair preferably lie in a common transverse and generally vertical plane, producing maximum stiffening action in a lateral direction.

Additional braces may be provided for making the chair legs more rigid. As illustratively shown, a diagonal brace 35 extends from the lower portion of each front leg 34 to primary member 40 at the center of front section 42 just below the seat. A horizontal side brace 47 extends between the front and rear legs on each side. Both those side braces and both diagonal braces 35 are preferably formed of a single unitary member 38. Corresponding cross bracing between the two rear legs of the chair is rendered unnecessary by the triangular leg structures 52, already described.

Figure 2:
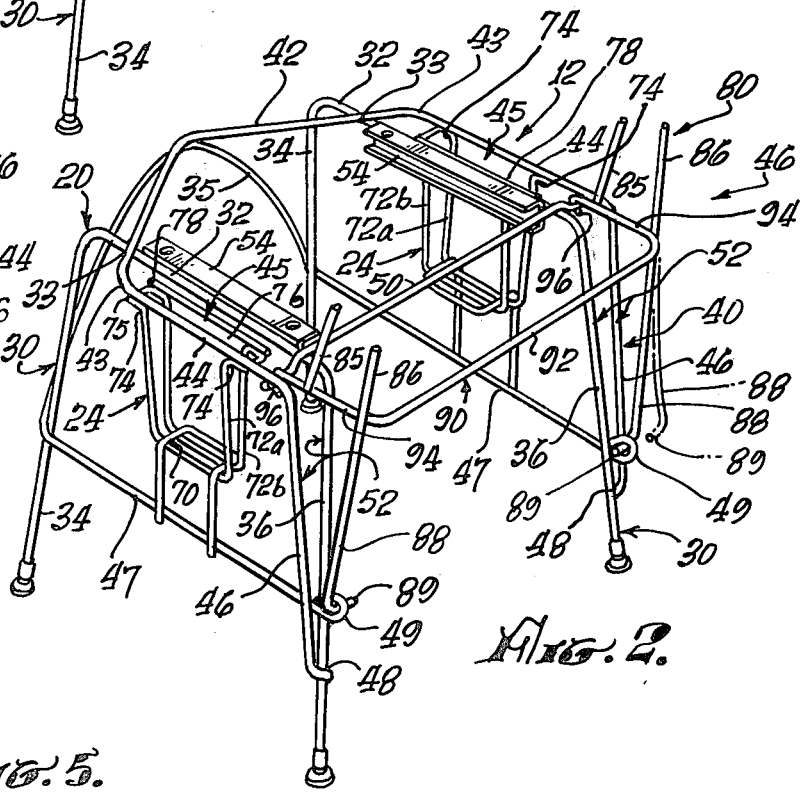
FIG. 2 is a fragmentary perspective of the chair of FIG. 1, omitting the seat and the upper part of the back.

As may be seen from FIG. 2, rear cross member 50 overlies each side section 32 near its rear end, while transverse front section 42 of the primary member similarly overlies that side section near its forward end at the welded connection 33. Front section 42 and cross member 50 thus lie in a common horizontal plane and provide a stable and secure support for seat 22, which may be held in place in any suitable manner.

A preferred form of coupling between seat 22 and the chair frame comprises the channel members 54 which are rigidly mounted on the frame, as by welding their webs to the respective side sections 32. The channel flanges of the two members extend toward each other, with the upper flanges in the horizontal plane defined by front section 42 and cross member 50, just described. The upper flanges then are convenient brackets for screw connection of seat 22, while the lower flanges jointly form a guideway for slidingly receiving and supporting the side flanges 56 of commode pan 55.

Each rail section 44 of primary frame member 40 is laterally spaced from the corresponding side section 32, forming a rigidly defined slot 45. The width of that slot is selected to make each rail section easily graspable by a hand, providing a convenient and strong handhold for a person sitting in the chair.

Transfer board 16 typically comprises a generally rectangular open frame 60 supporting a relatively thin but stiff panel 62 of material such as sheet metal, for example. The frame and panel are preferably coated with a suitable plastic which produces an effectively unitary, smooth and waterproof surface. The board is typically from about one to about two feet long, with a width one quarter to one half its length. Preferred dimensions are about 6 by about 15 inches. The extreme outer end portion 64 of the transfer board is cylindrically curved through about 90°, forming a rounded L-section in a longitudinal plane. The otherwise generally flat board thus terminates in an end edge which faces approximately perpendicular to the plane of the board.

Transfer board 16 carries at its inner end a hooklike formation 66 which projects laterally from the same face of the board as bend 64. Like that bend, formation 66 is typically of uniform section along the width of the board, but occupies only a portion of that width, typically terminating one or two inches in from both longitudinal board edges. Formation 66 forms with the board a full U-shape, projecting typically first for a short distance perpendicular to the board face and then angling back generally parallel to that face, preferably for a longer distance.

The particular transfer board configuration just described cooperates effectively with novel structure on the chair frame to perform multiple functions. One important aspect of that chair structure, already described, comprises the rail sections 44 along each side of the chair seat and the slots 45 laterally inward of those sections. A further important structural feature of the chair frame comprises the guide structures 24 which are mounted on each side of the chair and form generally vertical guideways leading downward from the respective slots 45. In the broader aspects of the invention, those guideways may be formed in any suitable manner. However, the specific structure shown in the drawings has been found especially effective, economical and convenient.

That illustrative guideway structure comprises the base member 70 of general U-form which is mounted by welding both ends of the U to the central portion of horizontal leg brace 47. The U typically extends first upward from that brace and then horizontally inward far enough to bring its inner end approximately vertically below slot 45. The guideway further comprises the four vertical guide bars **72*a* and 72*b* which extend from base member 70 up to substantially the level of slot 45. The two laterally outer bars 72*a* are spaced from the two corresponding inner bars 72*b* to freely receive the thickness of transfer board 60 and guide it in a lateral direction. Outer bars 72*a* are spaced from each other in a fore-and-aft direction by an amount less than the width of the transfer board and just sufficient to freely guide between them the hook formation 66, preventing skewing of the lower end of the board in its plane. The two inner bars 72*b*** are preferably laterally aligned with the respective outer bars.

In the present particular embodiment the four bars **72*a* and 72*b* maintain a similar relative configuration substantially up to the level of seat 22. At that level the forward pair of bars are offset forwardly and the rear pair rearwardly, as by right-angle bends at 74. The bars of each pair are then bent toward each other in a common, generally horizontal plane and are rigidly joined, forming in that plane a rectangular guide mouth 76 of suitable length to receive the full width of transfer board 60. The width of mouth 76 may be reduced from that of slot 45, as by insertion of the fore-and-aft bar 78. In preferred form of the guide structure, the forward rod pair and the rearward rod pair are each formed of a single member with its ends welded to base 70**. The described guideway configuration combines positive guiding action with provision of ample access for insertion of a hand below the seat, as for perineal therapy when the chair is used for toileting.

Back unit 14 typically comprises the back rest 80 and the back frame 82 on which it is mounted. Frame 82 is preferably formed of three unitary frame members which are rigidly joined as by welding to make an effectively unitary structure. The right and left side members 84 directly carry back rest 80 and are braced by the cross member 90. Each side member typically comprises the forward and rear sections 85 and 86, respectively, which diverge downward at a small acute angle from the hairpin bend at 87. Cross member 90 includes the lateral tie rod 92, which connects the rear sections of the two side members, and the two fore-and-aft braces 94, each of which connects the two sections of a side member. Each brace 94 projects forward beyond the side section 85, terminating in the hook formation 96, which curves downward and then obliquely back in a vertical plane. Each forward frame section 85 typically terminates at cross member 90, whereas the rear sections 86 continue downward as relatively long and laterally flexible bars 88. Those bars terminate in the laterally directed horizontal pins 89, which preferably point inward toward each other.

In operation of the described chair assembly, chair unit 12 by itself is capable of performing several useful functions. The entire structure is coated with a waterproof plastic, allowing the chair to be placed inside a shower stall, so that a patient can wash himself safely while in the seated position. Moreover, the chair frame is narrow enough in the lateral direction to fit within a bathtub. The chair then provides corresponding safety and convenience in aiding a tub bath. During such use the handholds provided by side rails 44 add significantly to the user's security.

The two rear legs of the chair frame, although close enough together to rest on the floor of a bathtub, are also far enough apart to straddle a conventional tiolet bowl; and the compact design of the main frame at the rear permits the seat to be properly centered over the toilet bowl even when the regular toilet seat and cover are raised. Thus the chair unit provides a sturdy and reliable toilet riser, solving the difficulties some patents experience due to the low level of conventional toilet seats.

For some uses, typified by the above described aids to bath and shower, the additional support of a chair back is usually helpful. For other uses a chair back would only be a physical obstacle. For example, presence of a back blocks proper placement over many conventional toilet bowls. Those contradictory conditions are met in the present structure by providing special coupling means by which back unit 14 can be quickly assembled on the chair frame or removed without any special mechanical skill and without use of any tools or auxiliary fittings whatever.

For assembly, back unit 14 is simply lowered into its normal position with respect to the chairframe, with the hooks 96 extending forward over cross member 50 and then down into the rearward ends of the respective slots 45. The slot portions adjacent member 50 act as upwardly opening sockets engageable by the hooks. With those hooks supporting the weight of the back unit on cross member 50, the two depending bars 88 are flexed laterally outward enough to allow pins 89 to enter the respective sockets 49 on the chair frame. Those sockets may be of any suitable construction that provides laterally opening mouths of dimensions for fittingly receiving the pins. In preferred form of the invention, leg braces 47 project rearwardly between leg sections 36 and 46 and are rolled up and back to form integral rings of suitable diameter in respective vertical planes. To remove the back unit, bars 88 are flexed to remove pins 89 from their sockets (FIG. 2) and the back is simply lifted from the chair frame.

The above described parts are so dimensioned that the seated pins 89 are normally securely retained in sockets 49 by stiffness of bars 88, and hooks 96 are then positively locked over cross member 50. Moreover, those hooks are accurately and securely positioned laterally by wedging action in the notch where the downwardly slanting cross member meets primary member 40. The back unit is thus mounted effectively rigidly on the chair frame.

A particularly economical and convenient feature of the described coupling structure is that all of the coupling fixtures are formed integrally as portions of regular structural members of the two frames to be coupled. That feature greatly simplifies mechanical fabrication and assembly of the parts. Also, the absence of any hinges, and even of any joints between fixtures and frame members, facilitates application of a strong and durable plastic coating on the entire structure.

Figure 5:
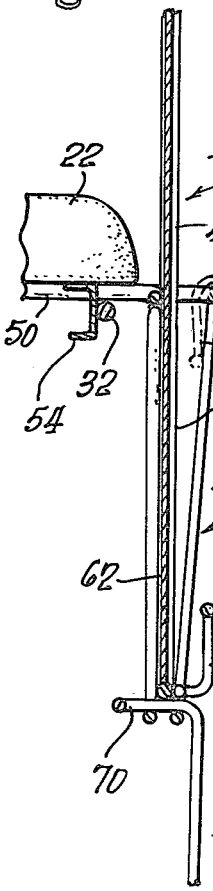
FIG. 5 is a fragmentary section on line 5—5 of FIG. 4.
Figure 3:
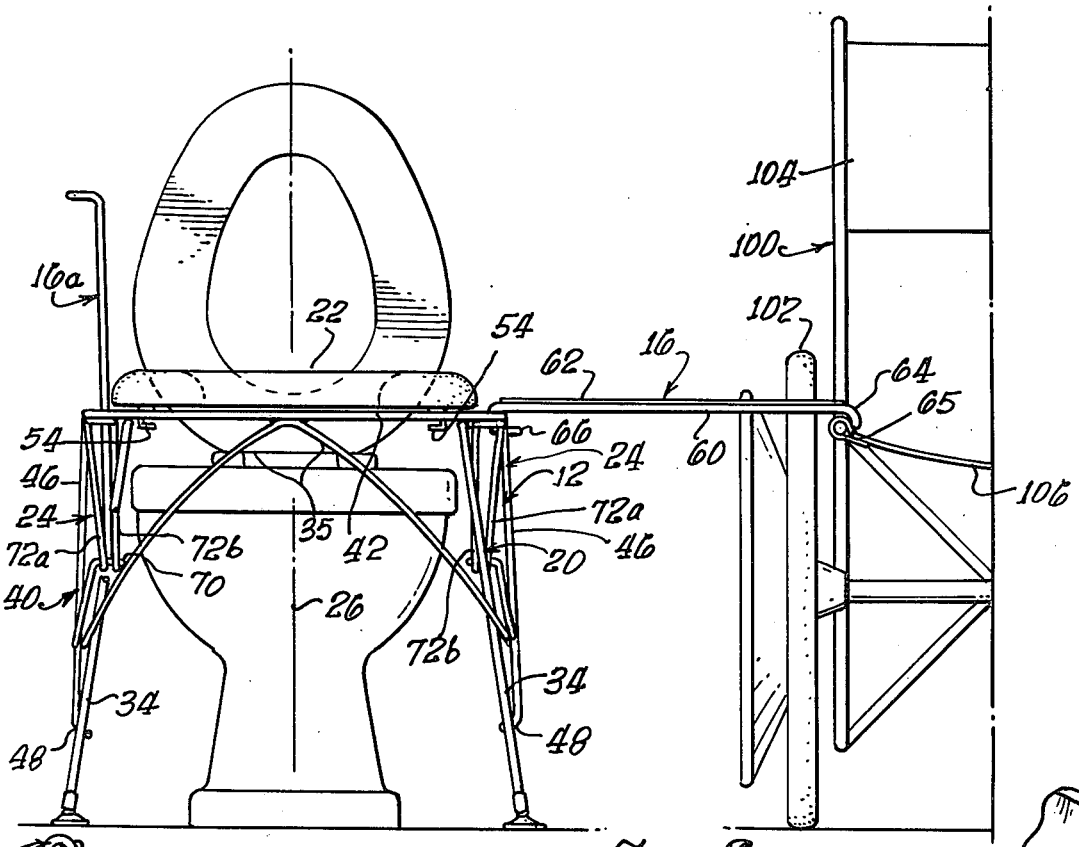
FIG. 3 is a front elevation, illustrating certain functions of the chair assembly.

To assemble one of the transfer boards 16 on the chair frame, its hook formation 66 is first engaged over the rail section 44 on the selected side of the chair frame, as typically shown in phantom lines in FIG. 5. The board is then swung laterally outward and up about rail section 44 as a pivot to the desired angle. Ordinarily the board is initially swung through about 180° to vertical position, and is then lowered into guideway 24 till its lower end is positively stopped by base member 70. That brings the board to its normal stowed position, as shown at the left of FIG. 3 and in FIGS. 4 and 5.

In that stowed position the curved upper portion 64 of the board forms an armrest which adds to both the security and the comfort of a person using the chair. For that reason many users will ordinarily keep both transfer boards installed on the chair frame in that stowed position. Removal of a board is readily done by simply reversing the assembly procedure, sliding the board up its guideway to engage the hinge structure provided by hook 66 and rail section 44, then swinging the board out about that hinge, and finally lifting the hook off the rail.

To shift a transfer board into position to aid a sliding transfer between the chair and another support such as a wheelchair, for example, the board is lifted in its guideway to engage the hinge, and is then swung down till its free end rests on the desired support. That position is typically shown in FIG. 3 with respect to a conventional wheelchair 100 with wheel 102, back 104 and seat 106. With the outer board end 65 resting on seat 106 of the wheelchair inwardly of the outer frame of the seat, the board is securely supported at both ends, enabling a seated person to slide along it in either direction between the two seats. Although hook formation 66 does not fully enclose rail section 44, the rail is effectively captured in that transfer position of the board since the board end is confined by the side edge of seat 22, side section 32 of the main frame and bar 78 of the guideway structure. Also, movement of the inner end of the transfer board longitudinally of rail section 44 is positively blocked by the two outer guideway bars 72*a* which straddle hook 66.

After the transfer has been completed, board 16 is readily returned to its stowed position, as already described. That capability is especially useful after transferring from a wheelchair to a chair unit 12 that has been placed in a shower stall. Stowing of the transfer board then permits the shower door or curtain to be fully closed.

Figure 4:
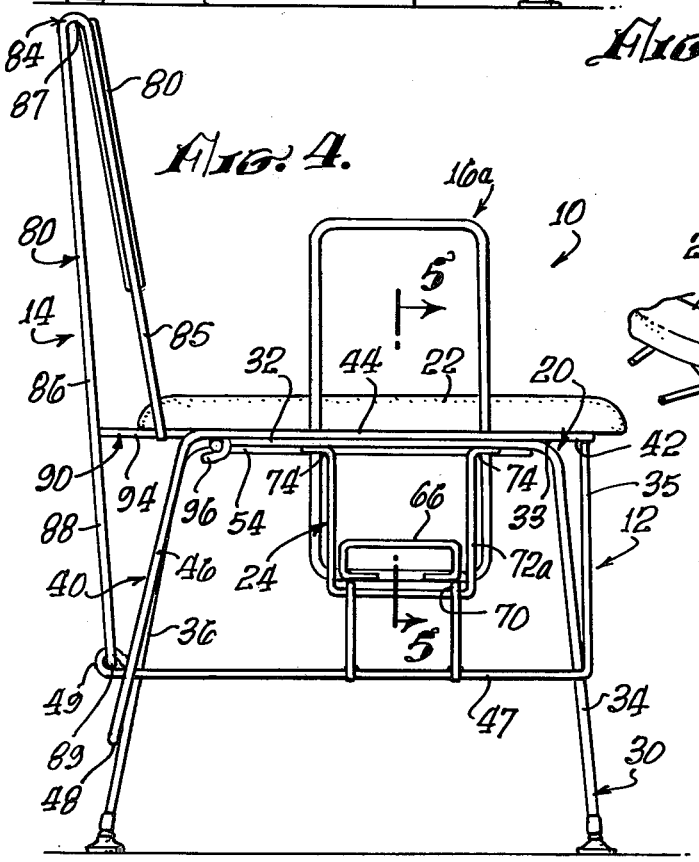
FIG. 4 is a side elevation.

In accordance with a further aspect of the invention, one of the two transfer boards 16 is formed without the panel 62, so that its rectangular frame 60 remains open, as indicated at 16*a* in FIGS. 1, 3 and 4. Such an open board can be retained in the stowed position when the chair is used as a toilet riser, for example, providing the support of an elevated armrest without interfering with the free access below the seat, already described. It will be noted that the transfer boards, as typically shown, are symmetrical with respect to a longitudinal plane and can be used interchangeably on either side of the chair. In view of that symmetry, and the ease with which interchange of the boards can be effected, a single open board and a single board with panel are usually sufficient; however, duplicate boards of either type or of both types may be provided if desired.

Figure 6:
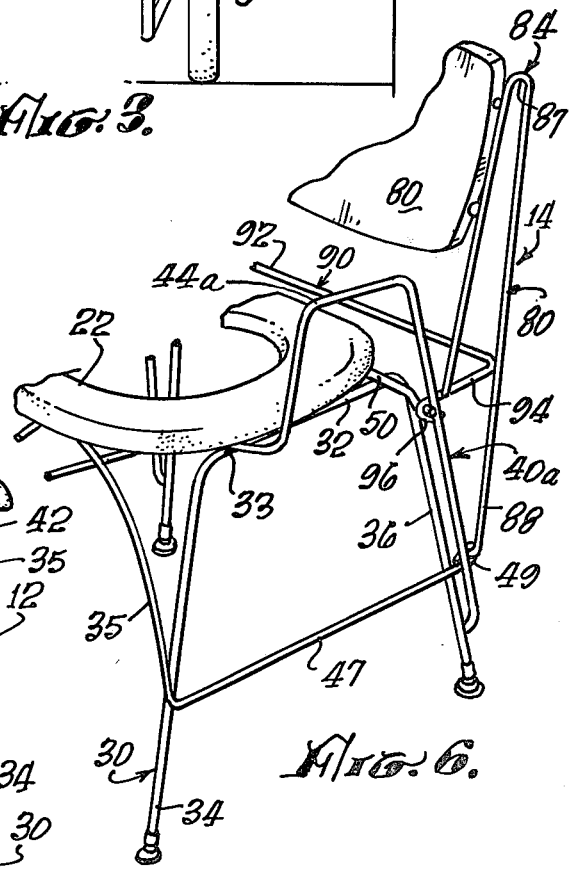
FIG. 6 is a fragmentary perspective representing a modification.

For patients who do not require the described transfer function, both boards 16 or 16*a* and guideway structures 24 may be omitted. The chair frame is then preferably modified to provide a permanent armrest in a normally elevated position on one or both sides of the chair. FIG. 6 represents a particularly effective and convenient manner of carrying out that modification, whereby substantially the only required structural alteration is the modified shape of primary member 40*a*. That modified aspect of the invention makes available in especially economical and convenient form the described primary functions and advantages concerned with toileting and bathing.

We claim:

1. A multi-purpose chair for an invalid, comprising a main chair frame including a seat and left and right pairs of front and rear legs, guide means forming a vertical guideway between and substantially in the plane of the legs of at least one said pair, such guideway extending downward from substantially the level of the seat, an elongated transfer board slidable in the guideway, means defining a normal lower position of the transfer board in the guideway such that the upper end of the board projects above the level of the seat and forms an arm rest, stop means for limiting upward sliding movement of the transfer board, said stop means including hinge means engageable in said upper board position for defining a hinge axis about which the board is swingable laterally outward about its lower end to a generally horizontal bridge position for forming a transfer bridge extending laterally from the seat.

2. Chair according to claim 1 wherein said hinge means positively prevents removal of the transfer board from the chair frame when in said bridge position and permits swinging movement of the transfer board beyond said bridge position to a downwardly inclined release position in which the board is removable from the chair frame.

3. Chair according to claim 1 wherein said stop and higne means comprise a generally horizontal pivot member mounted on the chair frame adjacent the outside of said guideway substantially at the level of the seat, and hook means mounted on the transfer board in position to partially enclose said pivot member as the board approaches said upper position.

4. Chair according to claim 3 wherein said guide means includes two mutually spaced, generally vertical guide members mounted substantially in a common plane with said pivot member, the width of said transfer board exceeds the mutual spacing of said guide members, and said hook means fits slidably between said guide members for preventing skewing of the lower portion of the board parallel to its plane.

5. Combination according to claim 4 wherein said guide members include generally horizontal upper portions which extend transversely of the pivot member and are oppositely offset longitudinally of that member to fittingly engage the respective side edges of the transfer board for preventing skewing of the upper portion thereof in its plane.

6. Combination according to claim 1 wherein said seat comprises a toilet seat and said pairs of legs are spaced from each other sufficiently widely to straddle a conventional toilet bowl and sufficiently closely to fit within a conventional bathtub.

7. Combination according to claim 6 including also a chair back which includes a back board and a back frame rigidly carrying the back board and extending downwardly therefrom for releasably mounting the same upon said main frame of the chair, said main frame including upwardly opening first socket formations rigidly mounted adjacent the respective rear corners of the seat and laterally opening second socket formations rigidly mounted on the respective rear chair legs at a level below the seat, and said back frame including right and left hook formations which extend substantially rigidly from the back frame forward and downward in position to engage said first socket formations, and laterally flexible right and left arms which extend downward from the back frame and carry at their lower ends oppositely directed lateral pin formations in position to be insertable into the respective second socket formations by virtue of the lateral flexibility of said arms, engagement of said pin formations positively locking the engagement of said hook formations.

8. In combination with a chair which includes a seat and a main frame forming front and rear legs for carrying the seat; quickly detachable back means comprising structure forming upwardly opening first sockets on the main frame adjacent the respective rear corners of the seat, structure forming second sockets on the respective rear legs and opening laterally in opposite directions along a common axis at a level spaced below the seat and approximately in the plane of the rear legs, a back board mounted on a back frame, right and left first coupling formations mounted on the back frame in position to be normally releasably engageable in the respective first sockets by bodily downward movement of the back frame relative to the main frame, laterally flexible right and left arms which extend downward from the back frame and carry at their lower ends oppositely directed second coupling formations in position to be releasably insertable in the respective second sockets by virtue of opposite flexing of said arms, engagement of said second coupling formations positively preventing upward bodily movement of the back frame relative to the main frame and thereby positively locking said engagement of said first coupling formations.

9. In combination with a chair which includes a seat and a main frame forming front and rear legs for carrying the seat; quickly detachable back means comprising structure forming upwardly opening first sockets on the seat, structure forming laterally opening second sockets on the respective rear legs at a level below the seat, a back frame comprising right and left unitary side members each including generally vertical forward and rear sections which diverge downward at a small acute angle, and a generally horizontal cross member interconnecting the two sections of each side member and interconnecting the side members at approximately the level of the seat, a back board mounted on said forward sections of the back frame, right and left hook formations mounted on the cross member and extending substantially rigidly forward and downward in position to be normally releasably engageable in the respective first sockets, said rear sections of the side members projecting downward beyond the cross member and forming laterally flexible right and left arms which carry at their lower ends oppositely directed lateral pin formations in position to be releasably insertable in the respective second sockets by virtue of the lateral flexibility of said arms, engagement of said pin formations positively locking said engagement of said hook formations.

10. In combination with a chair which includes front and back legs and a seat carried by the legs; quickly detachable back means having a normal assembled position relative to the chair and comprising right and left rod-like side members carrying a back and each including generally vertical forward and rear sections which diverge downward at a small acute angle, cross means for substantially rigidly interconnecting the two sections of each side member and also interconnecting the two side members at approximately the level of the chair seat, said rear sections projecting below the cross means as laterally flexible right and left arms, first coupling means mounted substantially rigidly on the back means and on the chair at approximately the level of the chair seat and interengageable by virtue of bodily movement of the back means downward relative to the chair to said normal assembled position, and second coupling means mounted substantially rigidly on the respective rear legs of the chair and on said right and left arms and interengageable by virtue of lateral flexure of the respective arms, engagement of the second coupling means positively preventing upward bodily movement of the back means relative to the chair and thereby locking the engagement of the first coupling means.

11. In a multi-purpose chair for an invalid, a main frame comprising right and left rod-like side members each integrally including a horizontal side section, a straight front leg section, and a straight rear leg section, a rod-like third member integrally including a horizontal laterally extending front section rigidly interconnecting said side members, right and left rail sections extending in parallel laterally outwardly spaced relation to the side sections of the respective said side members, and straight right and left rear leg sections, and a horizontal rear member rigidly interconnecting said side members adjacent the rearward ends of the side sections thereof and interconnecting each side member and said third member, said two rear leg sections on each side of the frame converging at a small acute angle and being rigidly connected adjacent their lower ends, and a toilet seat rigidly supported on said main frame with the rail sections of said third member laterally spaced from the respective side edges of the seat and forming secure hand holds.

12. In a multi-purpose chair, a frame according to claim 11 wherein said two rear legs are mutually spaced sufficiently widely to straddle a conventional toilet bowl, and both said right legs are sufficiently close to the corresponding left legs to fit within a conventional bathtub.

13. In a multi-purpose chair, a frame according to claim 11 and guide means forming a vertical guideway extending downward from between said rail section and said side section on at least one side of the main frame, an elongated transfer board slidable in the guideway, means defining a normal lower position of the transfer board in the guideway with the upper end of the board projecting above the level of the seat to form an armrest, and means at the lower end of the transfer board for cooperating with said rail section to limit upward sliding movement of the board and to form a hinge for outward lateral swinging movement of the board to substantially horizontal position to form a transfer bridge.

* * * * *